US007543345B2

(12) United States Patent
Wilson et al.

(10) Patent No.: US 7,543,345 B2
(45) Date of Patent: Jun. 9, 2009

(54) FACE CRADLE INSERT DEVICE

(76) Inventors: Kimberly Forness Wilson, 401 Park Dr., Grand Forks, ND (US) 58201; Bob K. Steers, 1915 21st Ave. South, Grand Forks, ND (US) 58201

( * ) Notice: Subject to any disclaimer, the term of this patent is extended or adjusted under 35 U.S.C. 154(b) by 42 days.

(21) Appl. No.: 11/763,106

(22) Filed: Jun. 14, 2007

(65) Prior Publication Data

US 2008/0047070 A1 Feb. 28, 2008

Related U.S. Application Data

(63) Continuation-in-part of application No. 11/466,482, filed on Aug. 23, 2006.

(51) Int. Cl.
*A47G 9/10* (2006.01)
*A47C 20/00* (2006.01)

(52) U.S. Cl. ..... 5/638; 5/644; 5/636; 5/622

(58) Field of Classification Search ..... 5/638, 5/636, 640, 632, 620–622, 661, 644, 654, 5/655.3, 922

See application file for complete search history.

(56) References Cited

U.S. PATENT DOCUMENTS

| | | | | |
|---|---|---|---|---|
| 3,337,883 | A * | 8/1967 | Allison | 5/638 |
| 5,095,569 | A * | 3/1992 | Glenn | 5/490 |
| 5,177,823 | A * | 1/1993 | Riach | 5/636 |
| 5,347,668 | A * | 9/1994 | Manning | 5/622 |
| 5,427,436 | A * | 6/1995 | Lloyd | 297/408 |
| 6,412,127 | B1 * | 7/2002 | Cuddy | 5/632 |
| 6,568,006 | B1 * | 5/2003 | Hyland | 5/421 |
| 6,745,418 | B1 * | 6/2004 | Turner, Jr. | 5/638 |
| 6,922,860 | B2 * | 8/2005 | Cuddy | 5/632 |
| 7,080,420 | B2 * | 7/2006 | Damron | 5/640 |
| 7,424,759 | B2 * | 9/2008 | Damron | 5/641 |
| 2006/0053557 | A1 * | 3/2006 | Damron | 5/640 |
| 2006/0225214 | A1 * | 10/2006 | Damron | 5/640 |
| 2008/0047069 | A1 * | 2/2008 | Wilson et al. | 5/622 |
| 2008/0047070 | A1 * | 2/2008 | Forness Wilson et al. | 5/636 |

OTHER PUBLICATIONS

"Supply Price List 2005," The Massage Store pamphlet.

Reynolds, personal letter to Kim Forness Wilson, Nov. 30, 2007, unpublished.

Colorado Healing Arts Products. Fleece Facehole Cushion. photograph of product, picture taken Jan. 8, 2008.

Massage Warehouse, Face Hole Cushion, website printout of <http://www.massagewarehouse.co.nz/store/product.php-?productid=16262&cat=267&page=1>, date unknown, New Zealand.

Patent Cooperation Treaty, International Search Report & Written Opinion of International Searching Authority, Aug. 5, 2008, PCT/US07/76470, 10 pages.

* cited by examiner

*Primary Examiner*—Robert G Santos

(57) ABSTRACT

A face cradle insert device for providing extra support to the neck and head area of a person during a massage and/or when lying down. The face cradle insert device includes a pad and a receiver opening, wherein the pad is removably attached to a face cradle of a massage table. The receiver opening vertically extends through the pad and includes a first portion and a second portion extending from the first portion. The first portion and the second portion are comprised of a configuration to comfortably fit the face of a user. The pad also includes at least one passageway horizontally extending through the pad, wherein the passageway fluidly connects with the receiver opening.

20 Claims, 16 Drawing Sheets

FACE CRADLE INSERT DEVICE

CROSS REFERENCE TO RELATED APPLICATIONS

I hereby claim benefit under Title 35, United States Code, Section 120 of U.S. patent application Ser. No. 11/466,482 filed Aug. 23, 2006. This application is a continuation in-part of the Ser. No. 11/466,482 application. The Ser. No. 11/466,482 application is currently pending. The Ser. No. 11/466,482 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to massage tables and more specifically it relates to a face cradle insert device for providing extra support to the head and neck area of a person during a massage and/or when lying down.

2. Description of the Related Art

Any discussion of the prior art throughout the specification should in no way be considered as an admission that such prior art is widely known or forms part of common general knowledge in the field.

Massage tables have been in use for years. Typically, massage tables are used in commercial massaging environments. A patient generally lies down on their stomach or back on the massage table. The massage tables are generally comprised of a foam or other cushiony material and usually include a face cradle. The face cradle generally extends from one end of the massage table and is comprised of a horseshoe structure. The face cradle allows the patient to stretch out on the massage table in a flat position.

Face cradles are generally manufactured to a single size. When a patient puts their face in the face cradle, the face cradle may prove to be uncomfortable for certain patients. The face cradle may be too small or just overall uncomfortable for individuals, wherein such individuals include but are not limited to smaller framed individuals and children.

In the past, people giving massages have generally placed a towel or other sheet material within the horseshoe of the face cradle to accommodate smaller framed patients. Placing a towel or other sheet over the face cradle can be uncomfortable for the patients and also does not generally provide an efficient place for the patient to put their head.

While these devices may be suitable for the particular purpose to which they address, they are not as suitable for providing extra support to the neck and head area of a person during a massage and/or when lying down. Standard face cradles generally come in a single size and are not adjustable. Massages can be uncomfortable for smaller framed individuals when the face cradle is too large.

In these respects, the face cradle insert device according to the present invention substantially departs from the conventional concepts and designs of the prior art, and in so doing provides an apparatus primarily developed for the purpose of providing extra support to the neck and head area of a person during a massage.

BRIEF SUMMARY OF THE INVENTION

In view of the foregoing disadvantages inherent in the known types of massage tables now present in the prior art, the present invention provides a new face cradle insert device construction wherein the same can be utilized for providing extra support to the neck and head area of a person during a massage.

The general purpose of the present invention, which will be described subsequently in greater detail, is to provide a new face cradle insert device that has many of the advantages of the massage tables mentioned heretofore and many novel features that result in a new face cradle insert device which is not anticipated, rendered obvious, suggested, or even implied by any of the prior art massage tables, either alone or in any combination thereof.

To attain this, the present invention generally comprises a pad and a receiver opening, wherein the pad is removably attached to a face cradle of a massage table. The receiver opening vertically extends through the pad and includes a first portion and a second portion extending from the first portion. The first portion and the second portion are comprised of a configuration to comfortably fit the face of a user. The pad also includes at least one passageway horizontally extending through the pad, wherein the passageway fluidly connects with the receiver opening.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a face cradle insert device that will overcome the shortcomings of the prior art devices.

A second object is to provide a face cradle insert device for providing extra support to the neck and head area of a person during a massage.

Another object is to provide a face cradle insert device that is contoured to fit a massage table face cradle.

An additional object is to provide a face cradle insert device that may be adaptable to different color choices and personalized covers.

A further object is to provide a face cradle insert device that increases the comfort for smaller framed patients/children during a massage.

A further object is to provide a face cradle insert device that may be utilized as a pillow.

A further object is to provide a face cradle insert device that is comprised of an inflatable structure.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
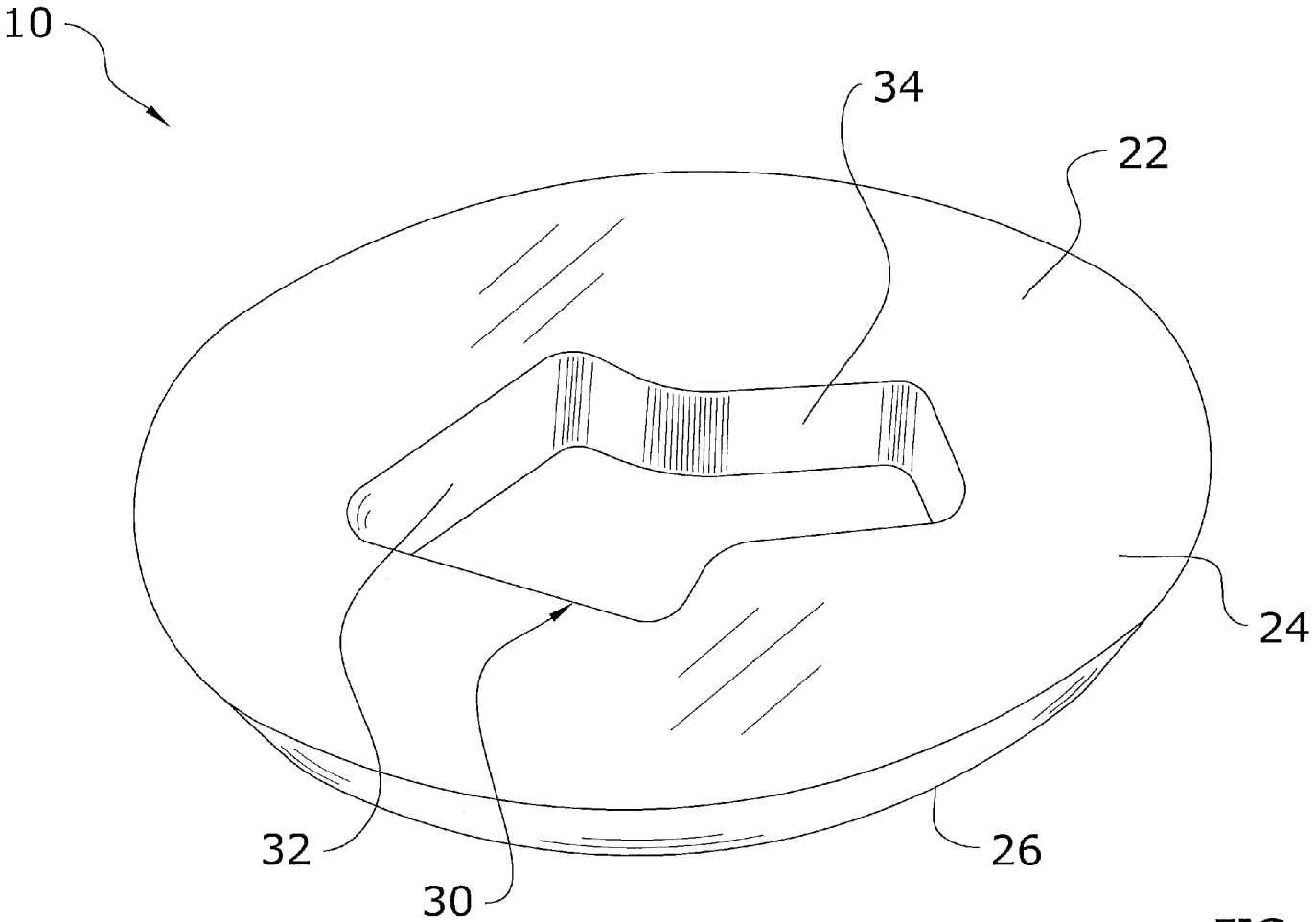
FIG. 1 is an upper perspective view of the present invention.
Figure 2:
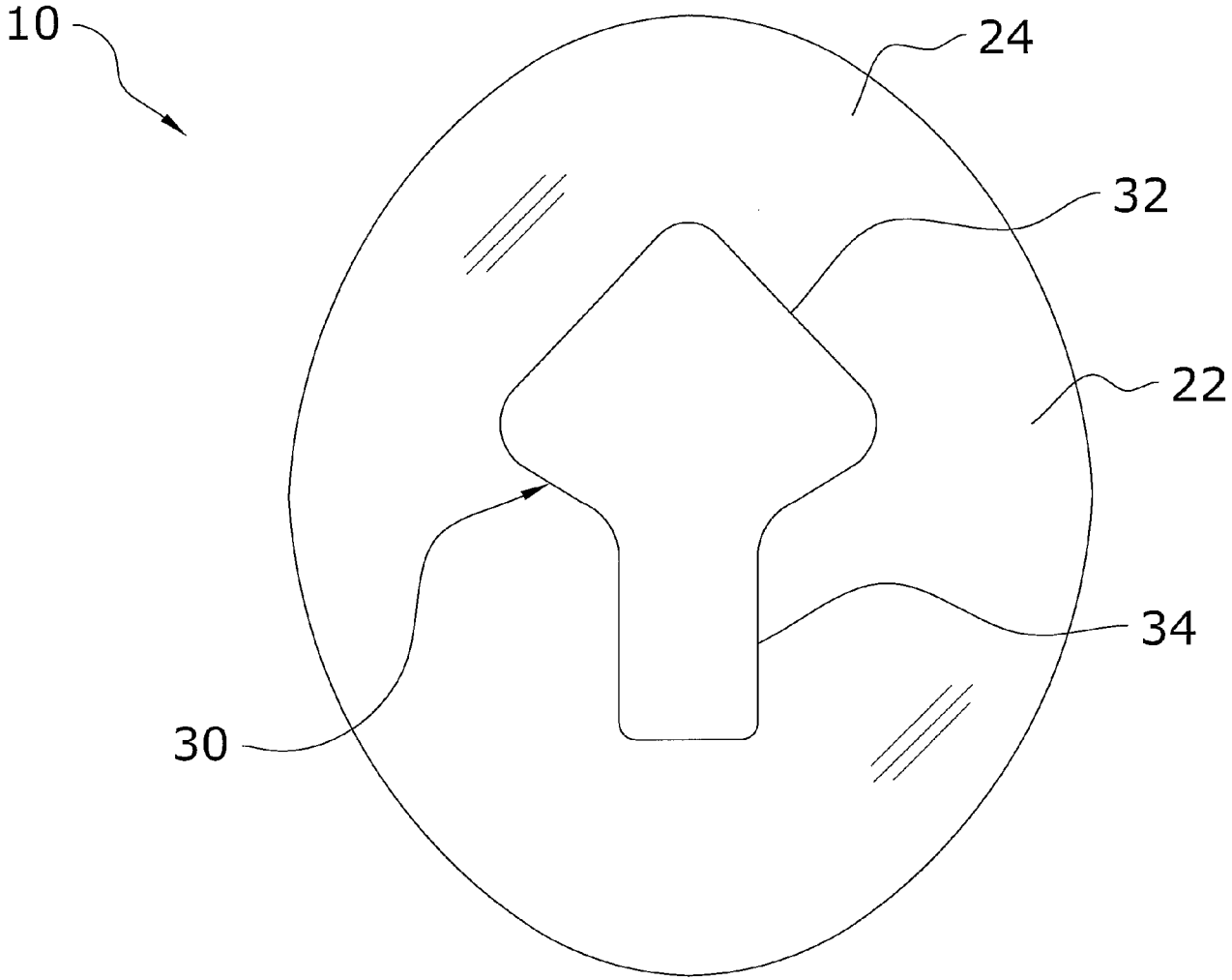
FIG. 2 is a top view of the present invention.
Figure 3:
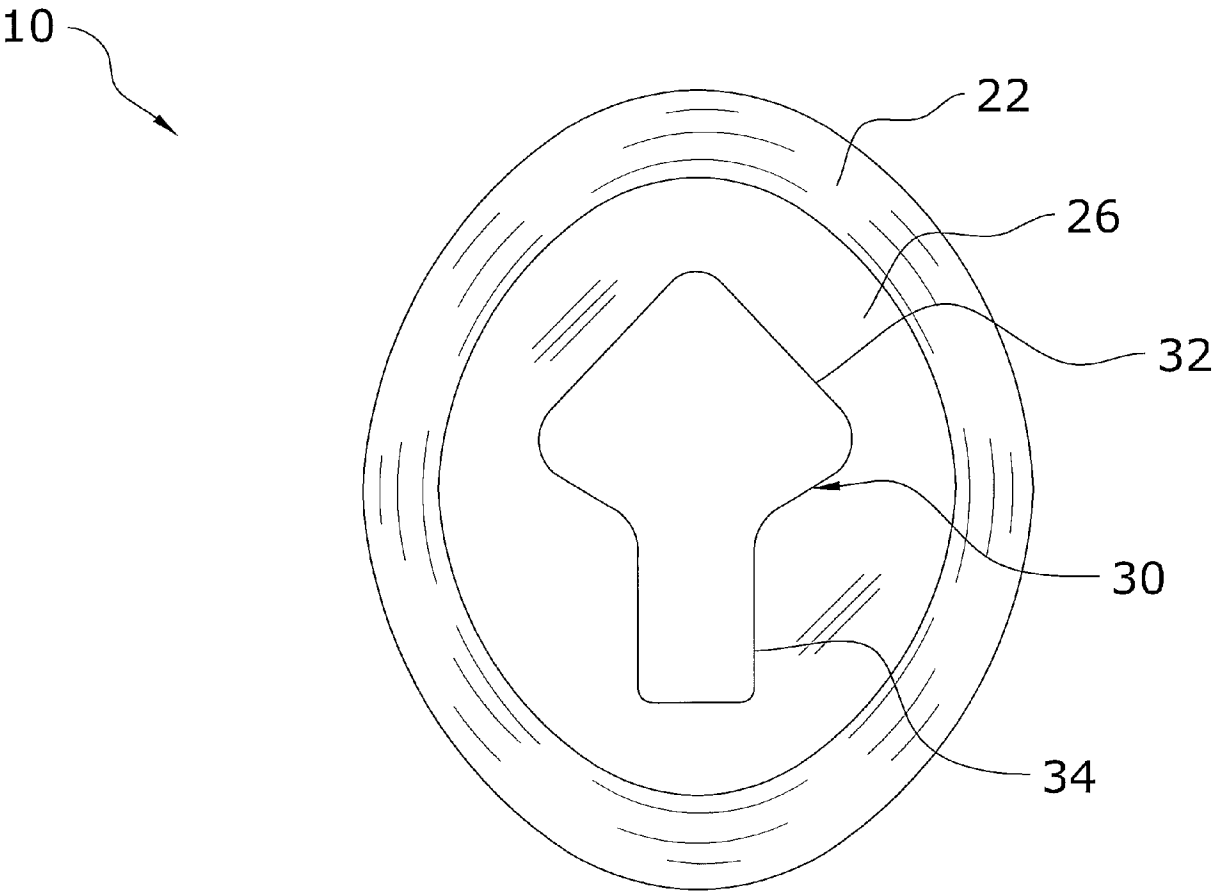
FIG. 3 is a bottom view of the present invention.

Turning now descriptively to the drawings, in which similar reference characters denote similar elements throughout the several views, FIGS. 1 through 16 illustrate a face cradle insert device 10, which comprises a pad 20 and a receiver opening 30, wherein the pad 20 is removably attached to a face cradle 14 or cradle support 16 of a massage table 12. The receiver opening 30 vertically extends through the pad 20 and includes a first portion 32 adjacent a first end 27 of the pad 20 and a second portion 34 adjacent a second end 28 of the pad 20.

The first end 27 is opposite the second end 28 upon the pad 20 and the second portion 34 extends from the first portion 32 within the receiver opening 30. The first portion 32 and the second portion 34 are comprised of a configuration to comfortably fit the face of a user. The pad 20 also includes at least one passageway 36 horizontally extending through the pad 20, wherein the passageway 36 fluidly connects with the receiver opening 30.

The face cradle 14 preferably extends out from an end of the massage table 12. The face cradle 14 is preferably comprised of a horseshoe configuration; however other structures and configurations of face cradles 14 may be utilized during the use of the face cradle insert device 10. The face cradle 14 and the massage table 12 are also both preferably comprised of a standard face cradle 14 and massage table 12.

It is also appreciated that the face cradle insert device 10 may be utilized without the use of the face cradle 14. Also, the face cradle insert device 10 is preferably a separate device than the face cradle 14; however the face cradle insert device 10 may be integrally formed with the face cradle 14.

The massage table 12 may also include a cradle support 16 extending outwardly from the massage table 12 in a similar manner as the face cradle 14. In the prior art, the cradle support 16 is generally comprised of a metal or other rigid structure to support the face cradle 14. The cradle support 16 in the present invention preferably includes a plurality of first attachment members 18 to removably attach to a plurality of second attachment members 19 upon the lower end of the pad 20 as illustrated in FIGS. 9 through 12.

Figure 16:
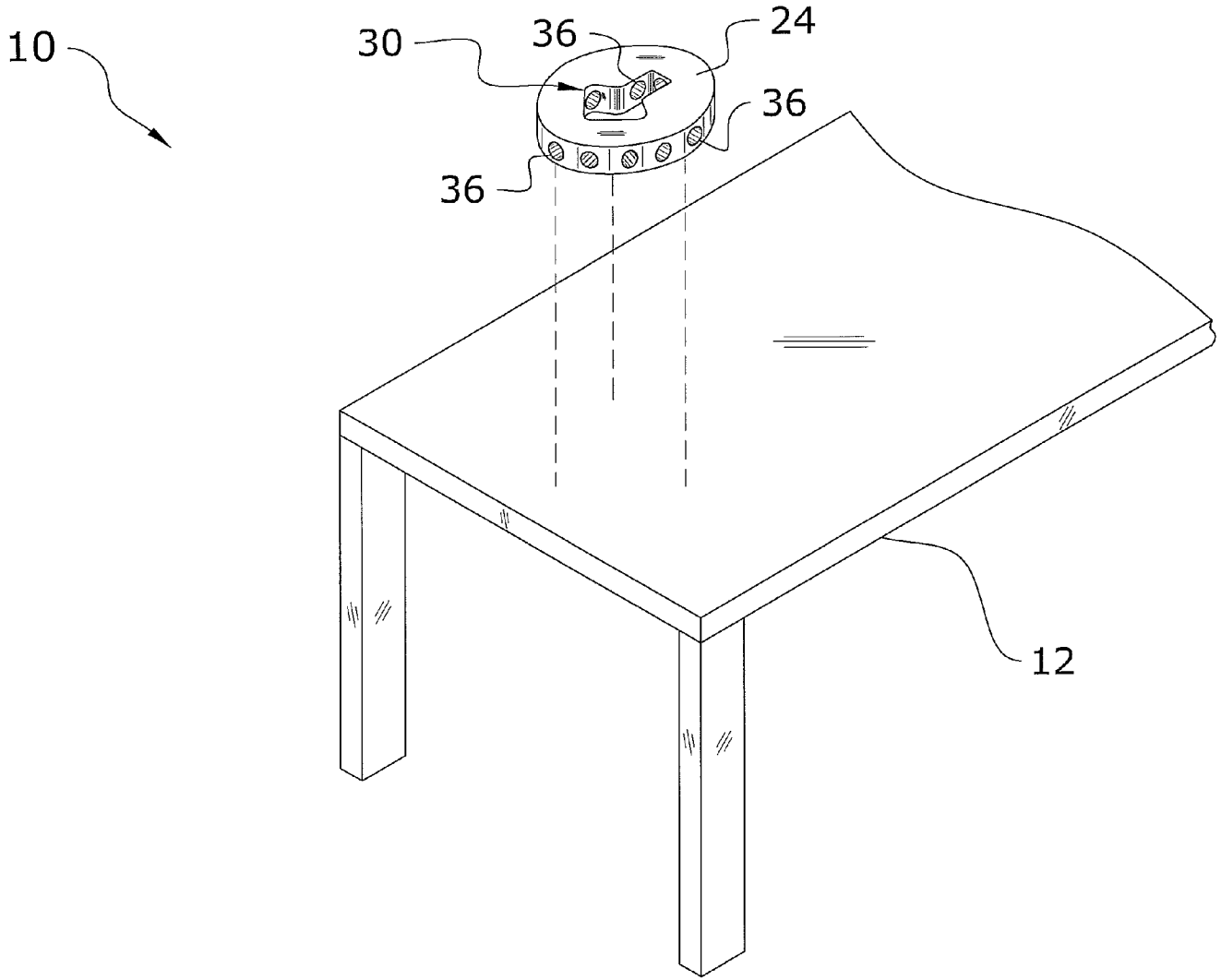
FIG. 16 is an upper perspective view of the present invention including a plurality of breathing passageways and exploded from a table.

It is appreciated that the present invention may also be utilized upon various flat surfaces or tables as illustrated in FIG. 16, wherein the passageway 36 provides an air hole for the user to breathe. It is appreciated that the pad 20 may also be utilized as a pillow and the massage table 12 omitted.

B. Pad

Figure 5:
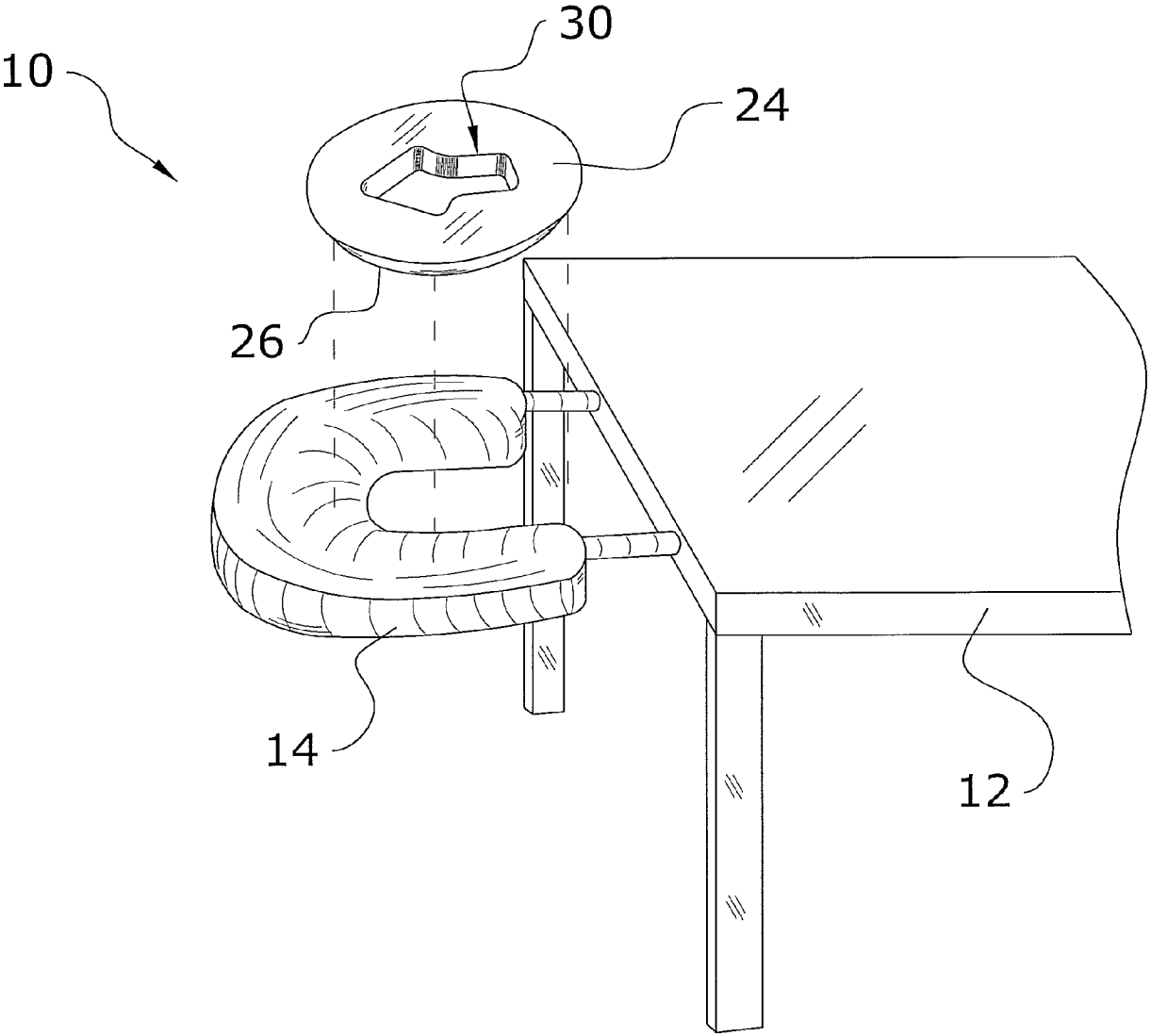
FIG. 5 is an upper perspective view of the present invention exploded from a massage table.
Figure 6:
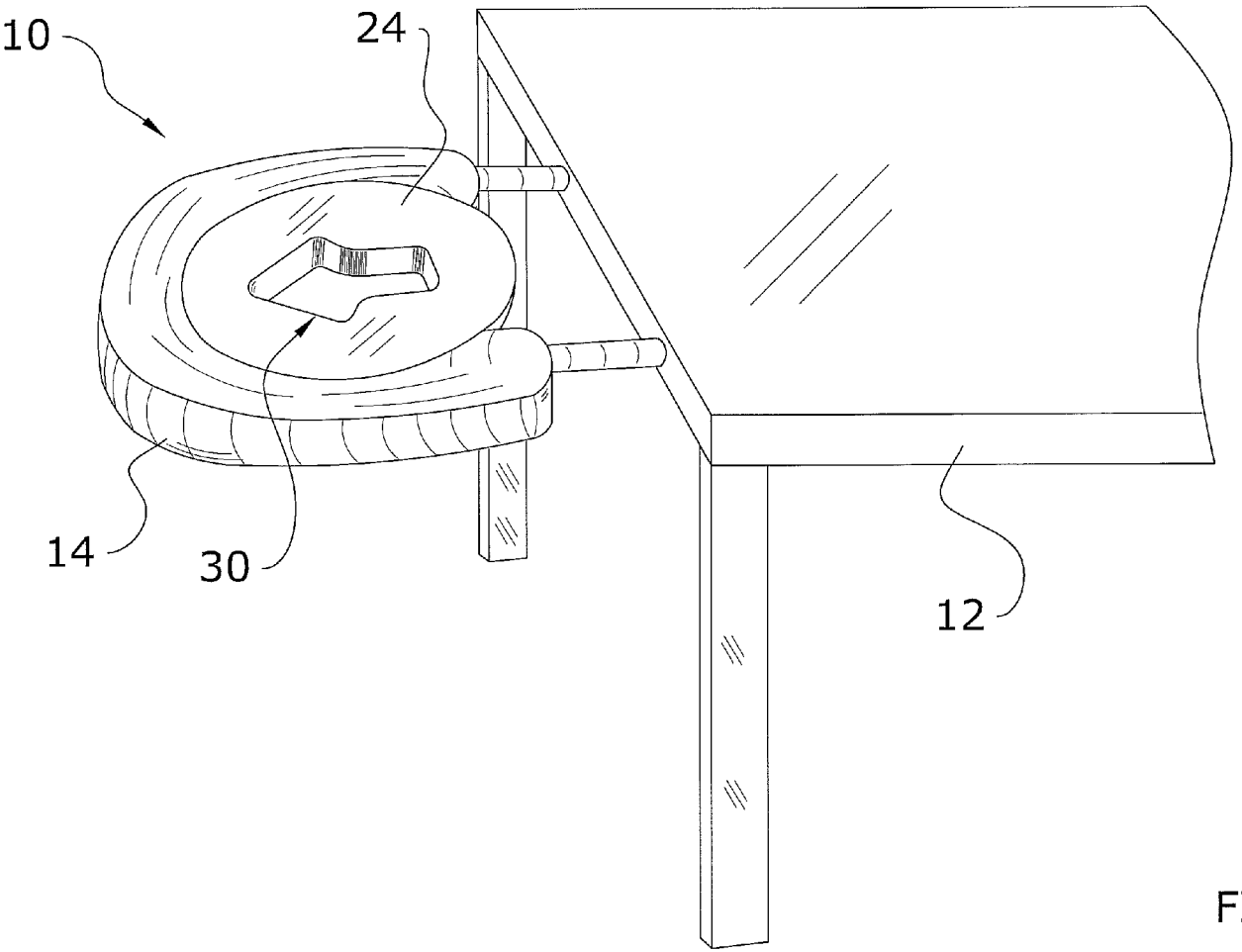
FIG. 6 is an upper perspective view of the present invention in use.
Figure 9:
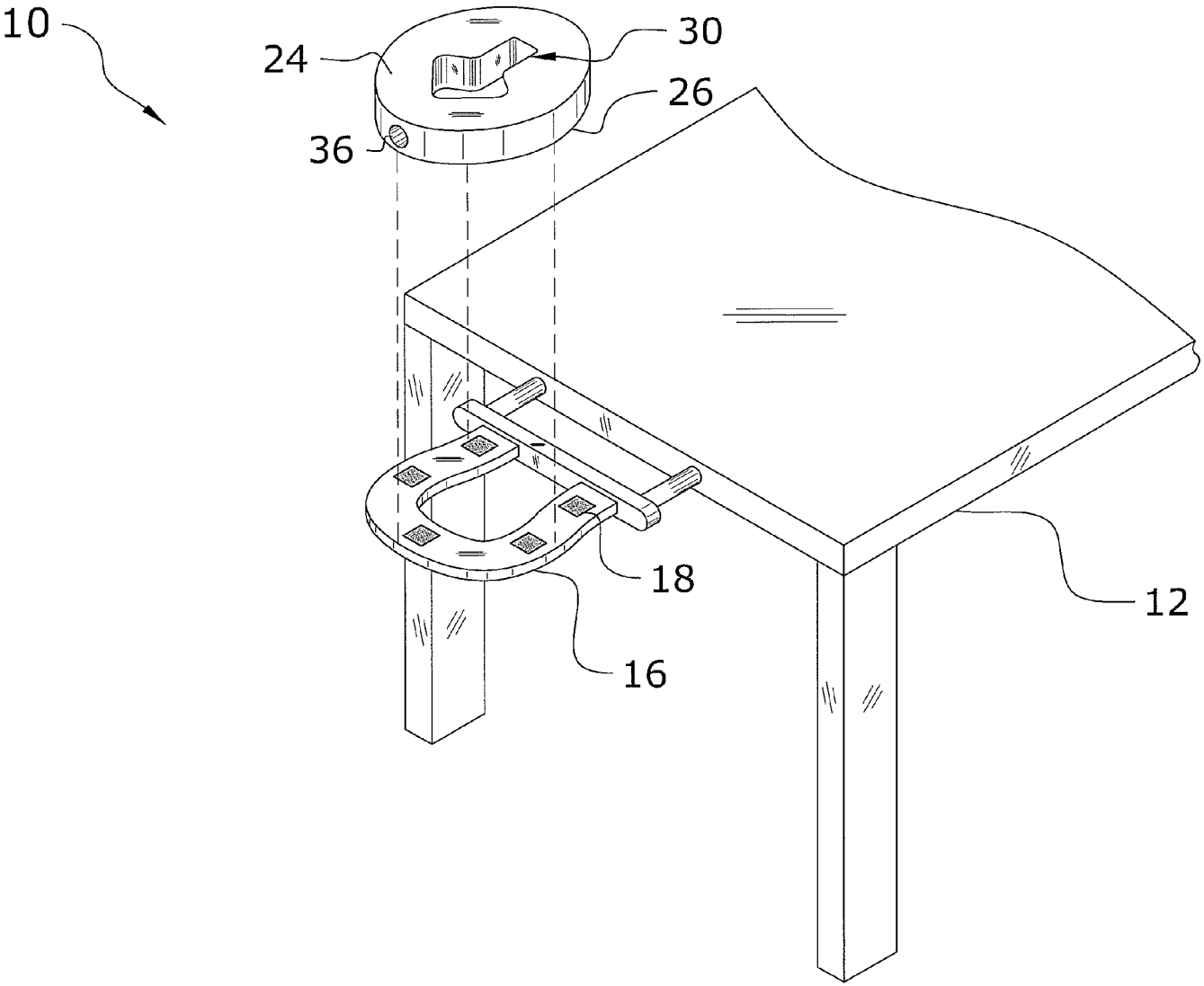
FIG. 9 is an upper perspective view of the present invention including the breathing passageway and exploded from a support of a table.
Figure 10:
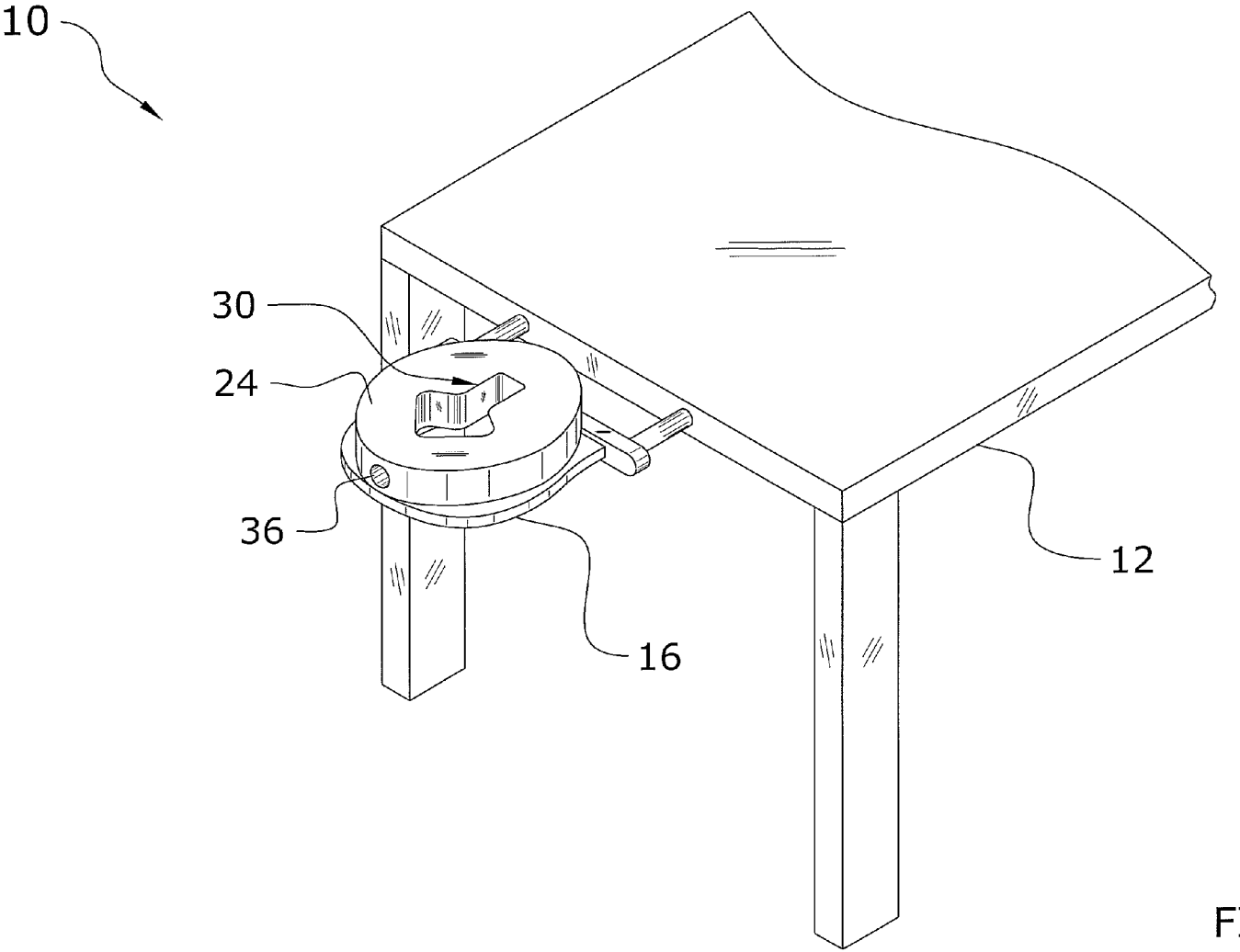
FIG. 10 is an upper perspective view of the present invention including the breathing passageway and attached to the support.

The pad 20 preferably fits within the face cradle 14 of the massage table 12 as illustrated in FIGS. 5 and 6. The pad 20 is preferably comprised of an oval shape to fit securely in the face cradle 14; however other shapes may be utilized in the construction of the pad 20. The pad 20 may also attach to the upper end of the cradle support 16 as illustrated in FIGS. 9 and 10. The pad 20 is also preferably comprised of a foam material. It is appreciated that the pad 20 may be comprised of a variety of materials other than the foam material. It is further appreciated that the face cradle insert device 10 may include a plurality of pads 20 stacked upon one another, rather than a single pad 20.

The pad 20 may be tapered vertically so as to be wedged into an opening of the face cradle 14 of the massage table 12. The pad 20 is preferably tapered in a manner that a perimeter of the upper side 24 of the pad 20 is greater than a perimeter of the lower side 26 of the pad 20 as shown in FIGS. 1 through 7. The perimeter of the upper side 24 of the pad 20 is also preferably greater than the perimeter of the opening of the face cradle 14 and the perimeter of the lower side 26 is preferably of a lesser distance than the perimeter of the opening of the face cradle 14 as illustrated in FIGS. 5 and 6.

Figure 4:
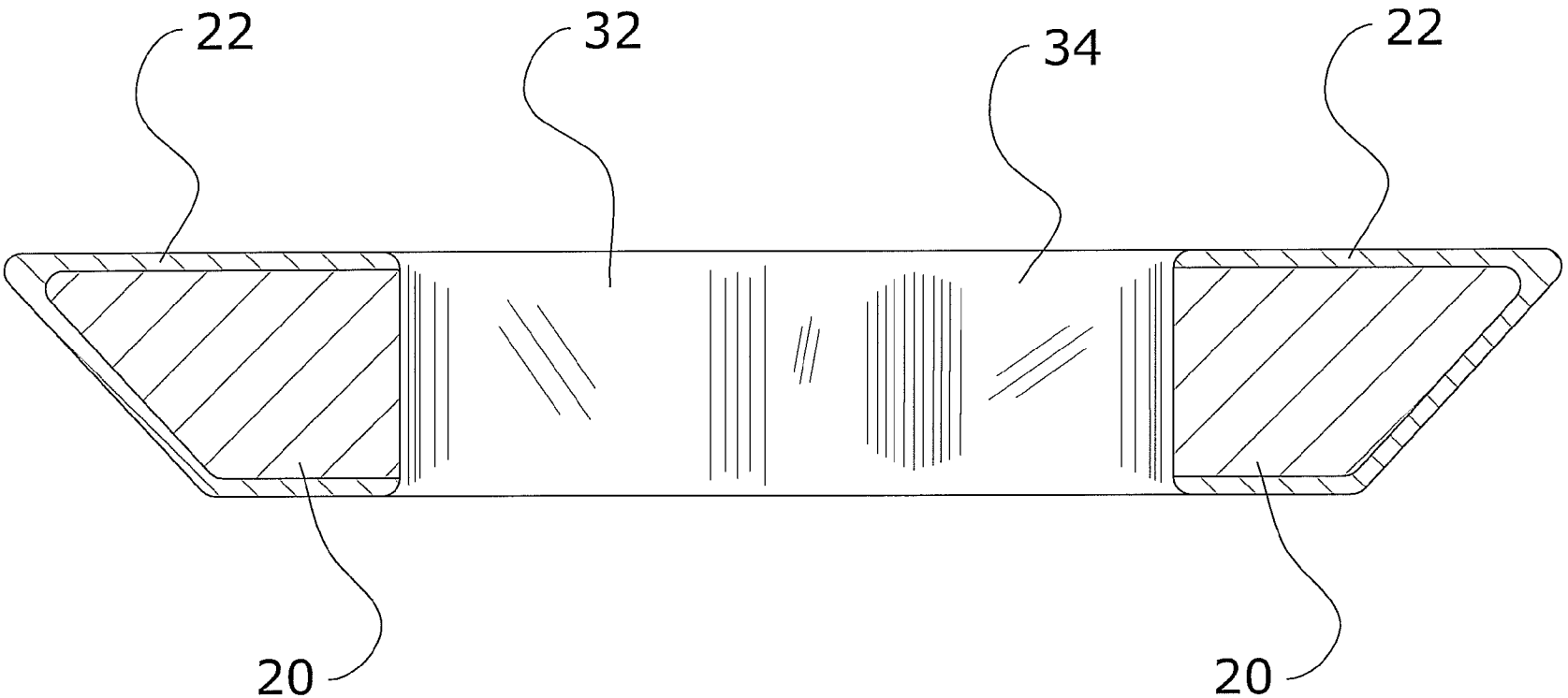
FIG. 4 is a cross-sectional view of the present invention.

The pad 20 also preferably includes a cover 22. The cover 22 preferably completely surrounds the pad 20 as shown in FIG. 4. The cover 22 also preferably surrounds the walls of the receiver opening 30. The cover 22 is also preferably comprised of a vinyl material; however other material may be utilized in the construction of the cover 22, such as but not limited to fleece and terry cloth. The cover 22 also may also be personalized to include various indicia and colors.

Figure 13:
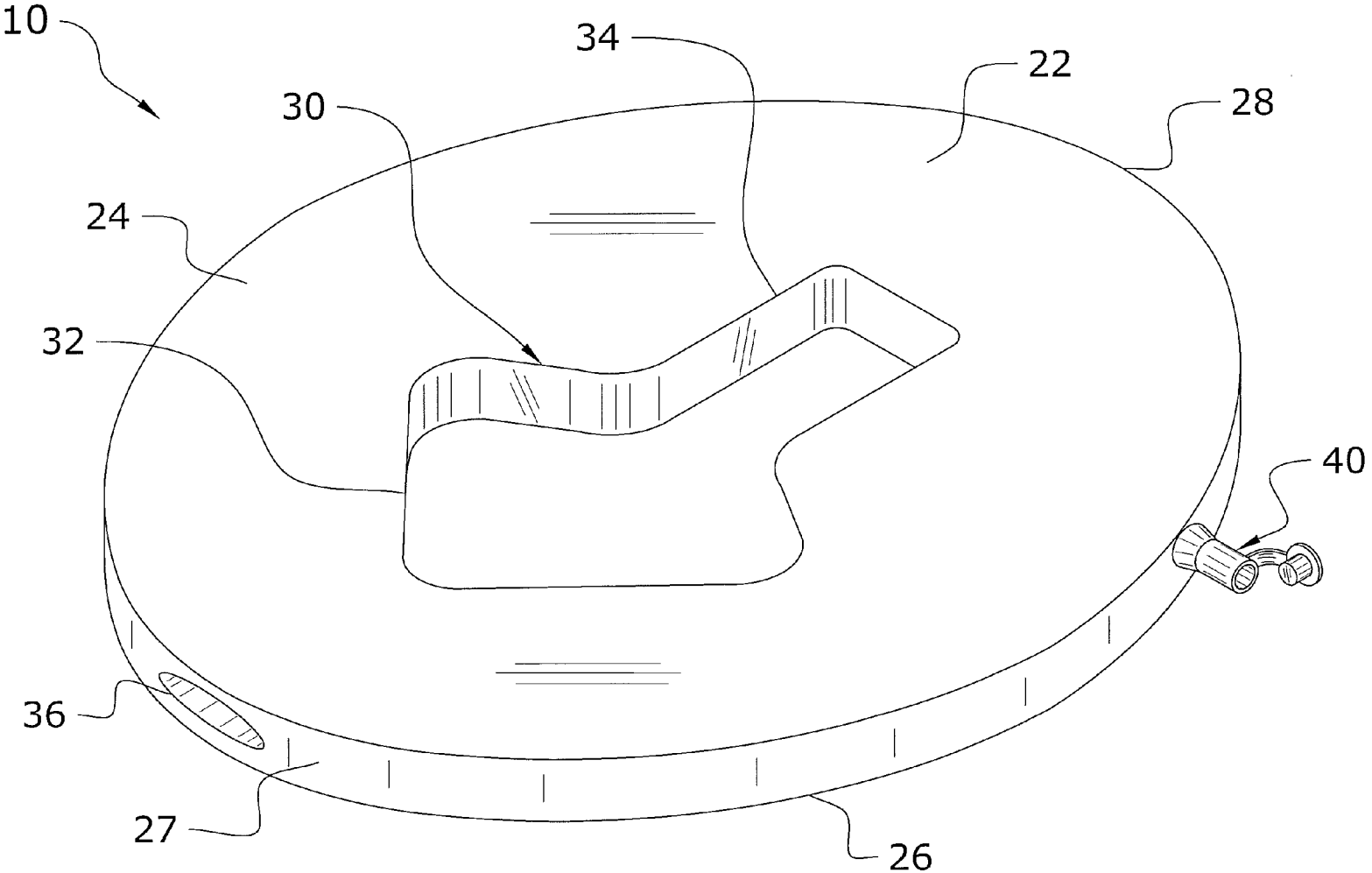
FIG. 13 is a cross-sectional view of the present invention including a breathing passageway and comprised of an inflatable structure, wherein the present invention is deflated.
Figure 14:
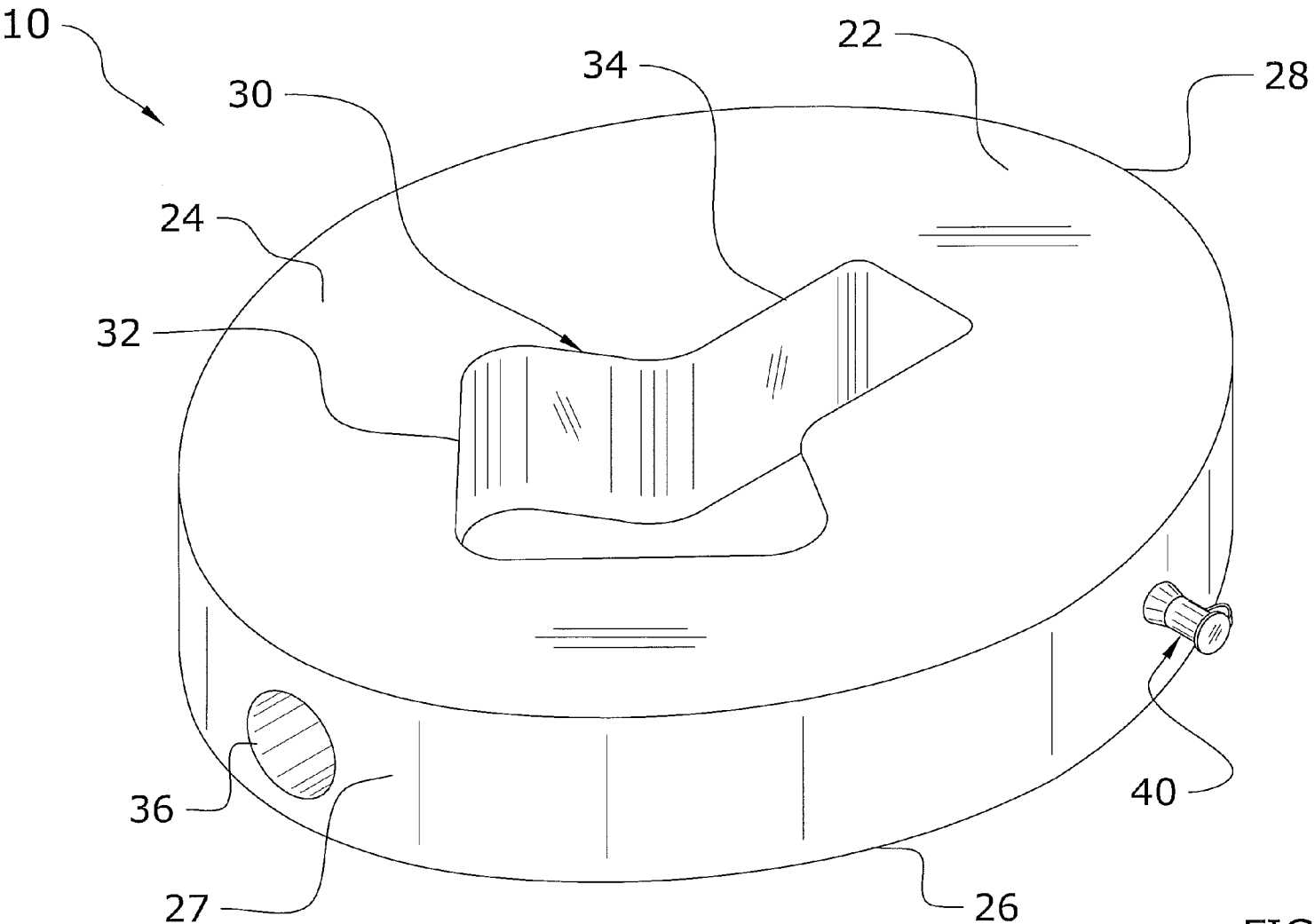
FIG. 14 is a cross-sectional view of the present invention including the breathing passageway and comprised of an inflatable structure, wherein the present invention is inflated.
Figure 15:
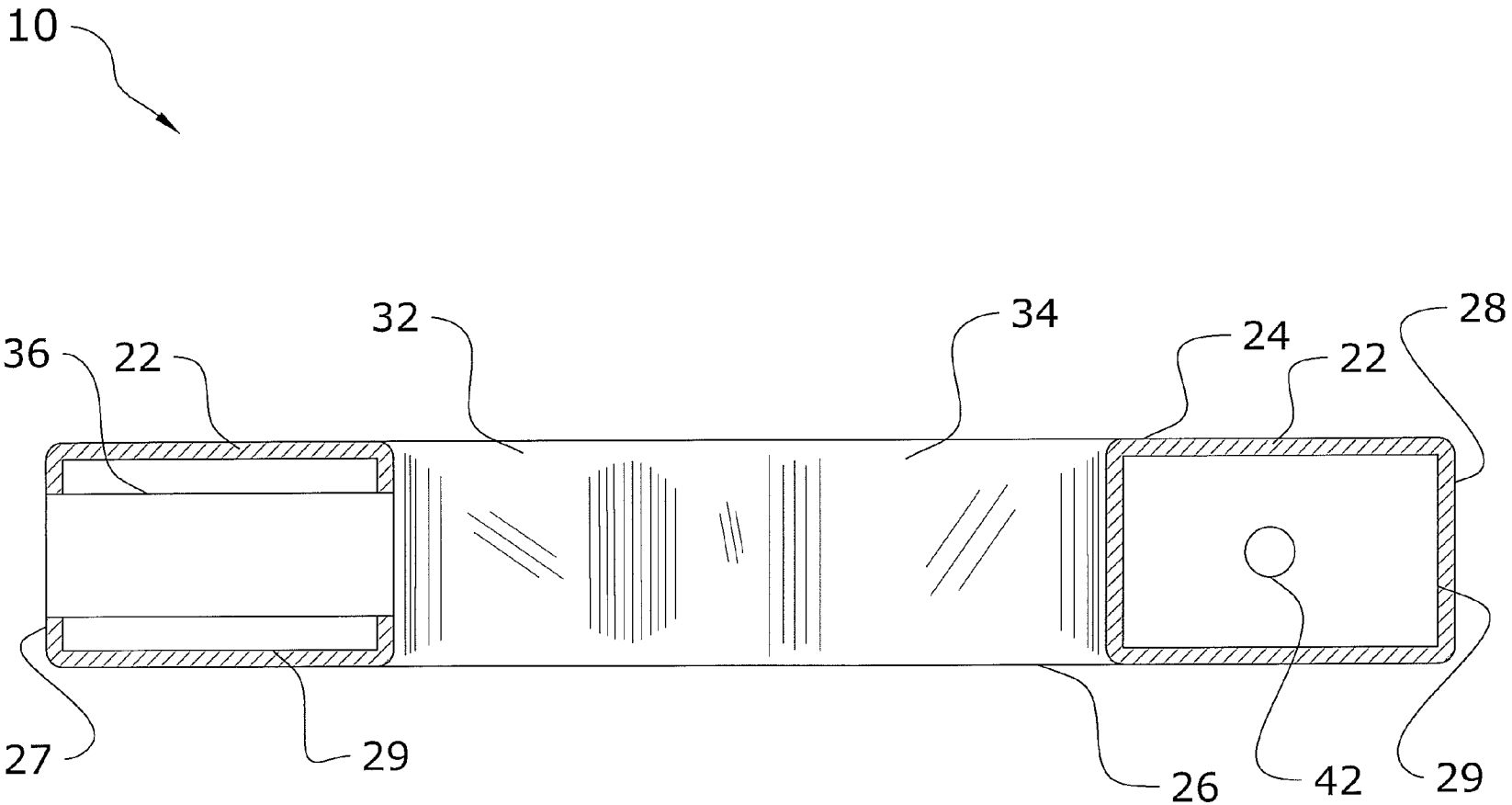
FIG. 15 is a cross-sectional view of the present invention including the breathing passageway and comprised of an inflatable structure.

It is appreciated that the pad 20 may also be comprised of an inflatable structure as illustrated in FIGS. 13 through 15. The pad 20 may be comprised of a self-inflatable structure. The pad 20 may also include an inflatable chamber 29 extending within the pad 20 as illustrated in FIG. 15. The chamber 29 is fluidly connected to a side opening 42, wherein passage of air and/or fluid through the side opening 42 and within the chamber 29 is regulated via a valve 40.

The valve 40 extends from the side opening 42 as illustrated in FIGS. 13 and 14. It is appreciated that the valve 40 extends from the side of the pad 20, wherein the valve 40 does not interfere with the usage of an upper side 24 or a lower side 26 of the pad 20. The valve 40 may be comprised of various configurations all which regulate a passage of fluid/air through the side opening 42.

Figure 11:
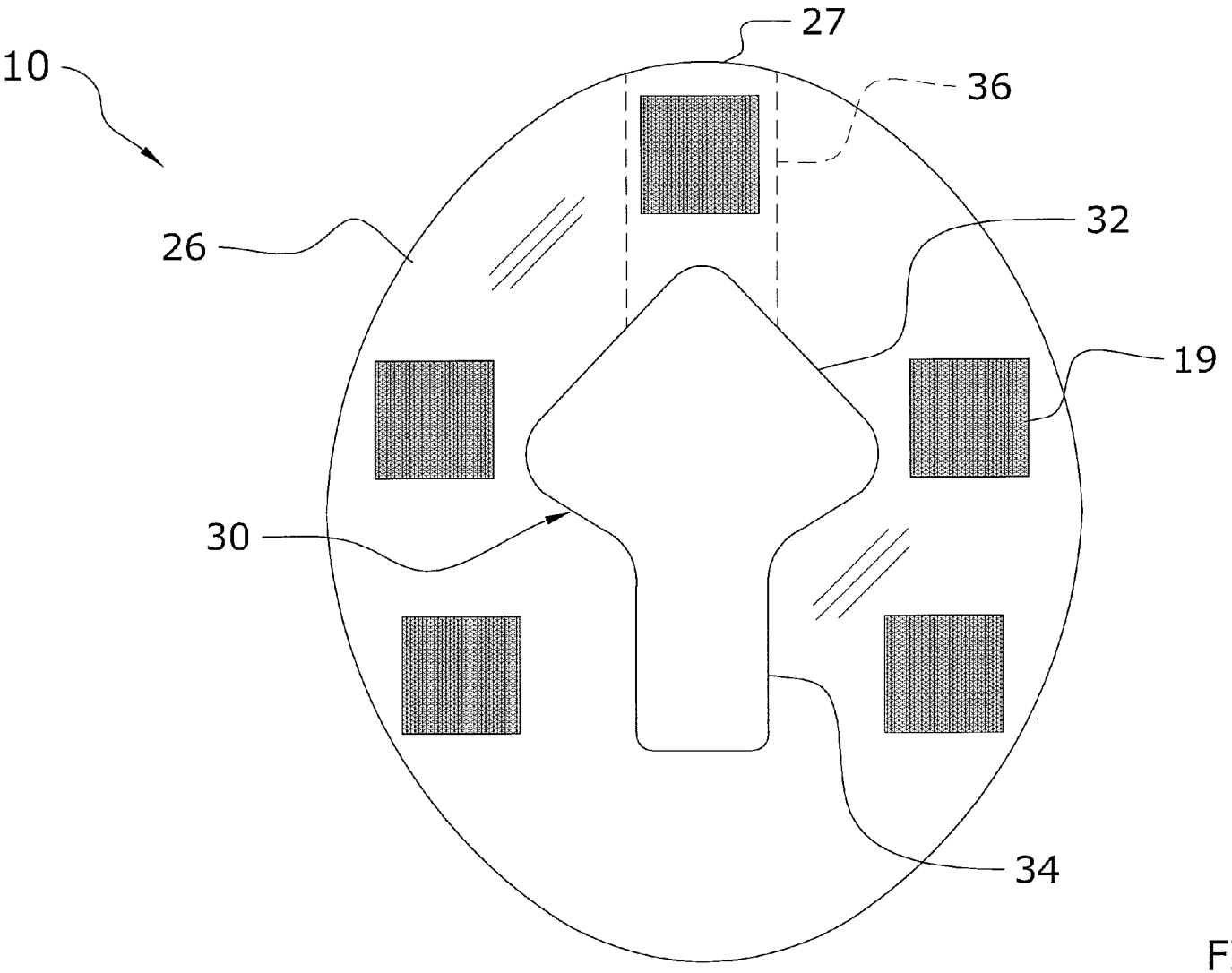
FIG. 11 is a bottom view of the present invention including the breathing passageway.
Figure 12:
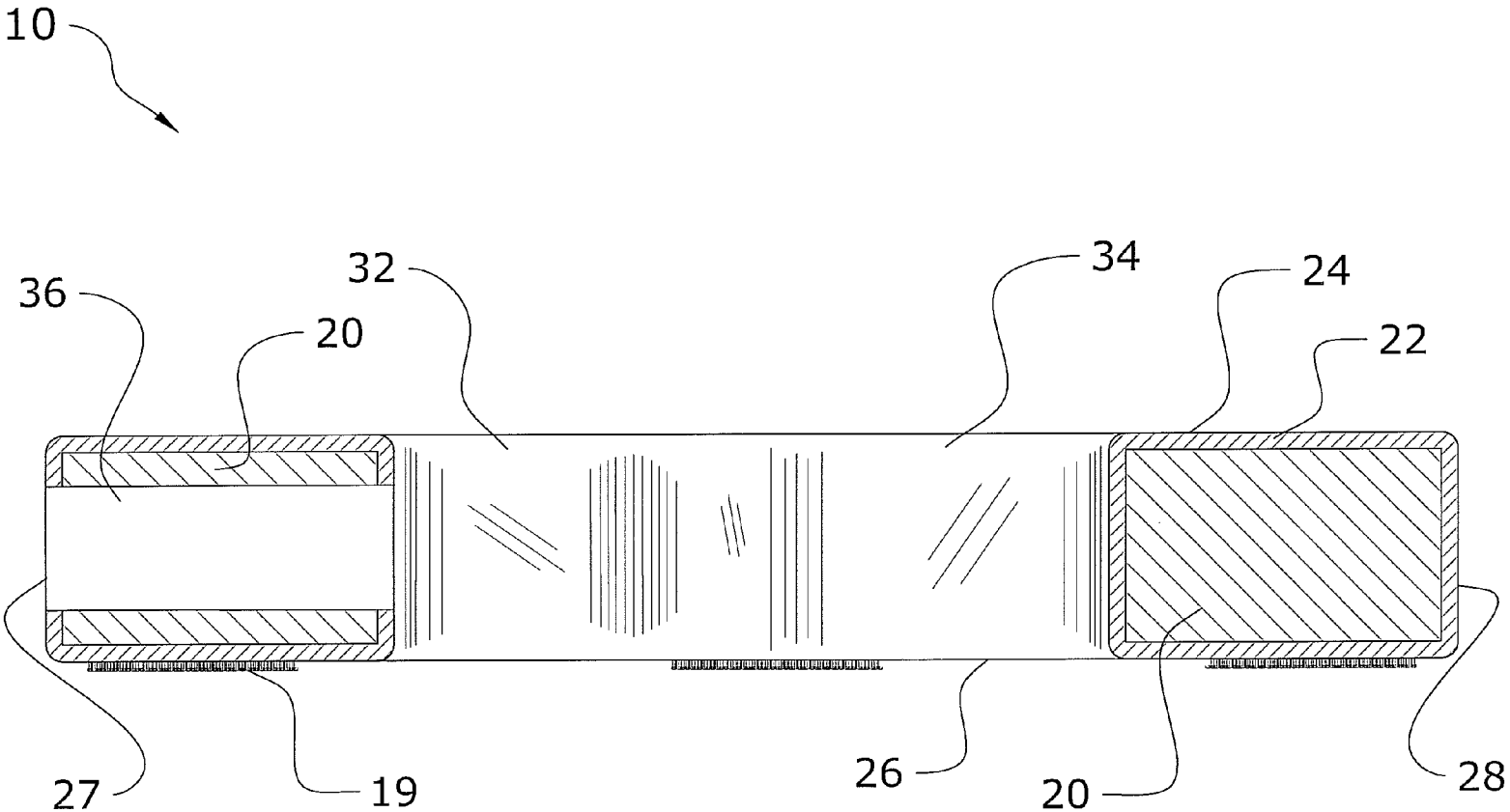
FIG. 12 is a cross-sectional view of the present invention including the breathing passageway.

The pad 20 may include a plurality of second attachment members 19 extending from the lower side 26 of the pad 20 as illustrated in FIGS. 11 and 12. The second attachment members 19 preferably removably attach to a plurality of first attachment members 18 upon the cradle support 16 or other table/surface utilized to support the pad 20. In the preferred embodiment the first attachment members 18 and the second attachment members 19 are comprised of a hook and loop attachment configuration; however it is appreciated that the first attachment members 18 and the second attachment members 19 may be comprised of various configurations, such as but not limited to snaps.

C. Receiver Opening

The receiver opening 30 is comprised of a configuration to promote easy breathing by the user while the user's face is against the upper side 24 or lower side 26 of the pad 20. The receiver opening 30 extends vertically through the pad 20. The receiver opening 30 preferably includes a first portion 32 and a second portion 34. The receiver opening 30 also extends vertically through the pad 20 between the first end 27 and the second end 28 of the pad 20.

The second portion 34 of the receiver opening 30 preferably horizontally extends from the first portion 32 of the receiver opening 30 as illustrated in FIGS. 1 through 7. A centroid of the first portion 32 and a centroid of the second portion 34 also preferably align with a longitudinal center axis of the pad 20.

Figure 7:
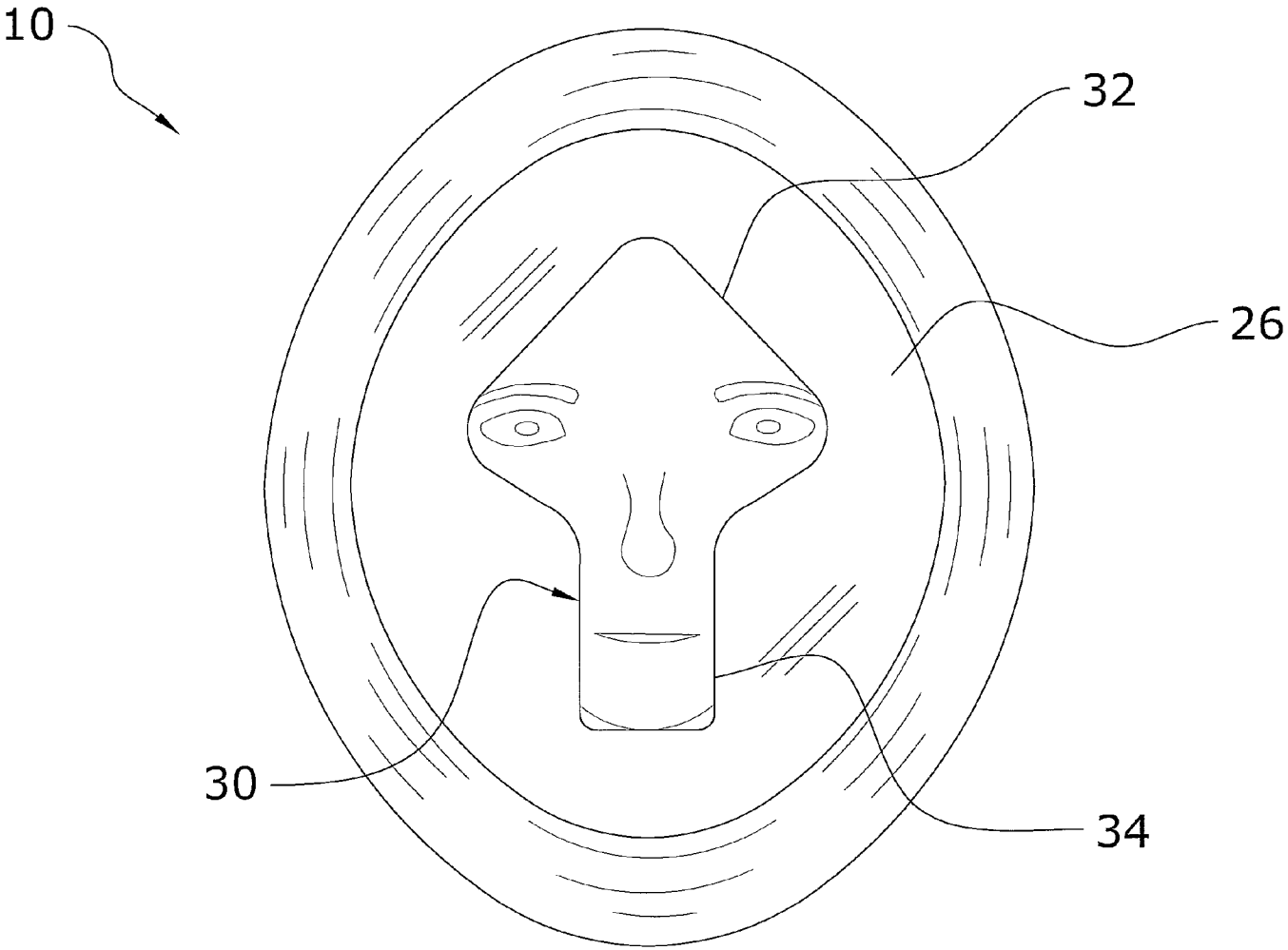
FIG. 7 is a bottom view of the present invention showing the preferred alignment of a face positioned within the present invention.
Figure 8:
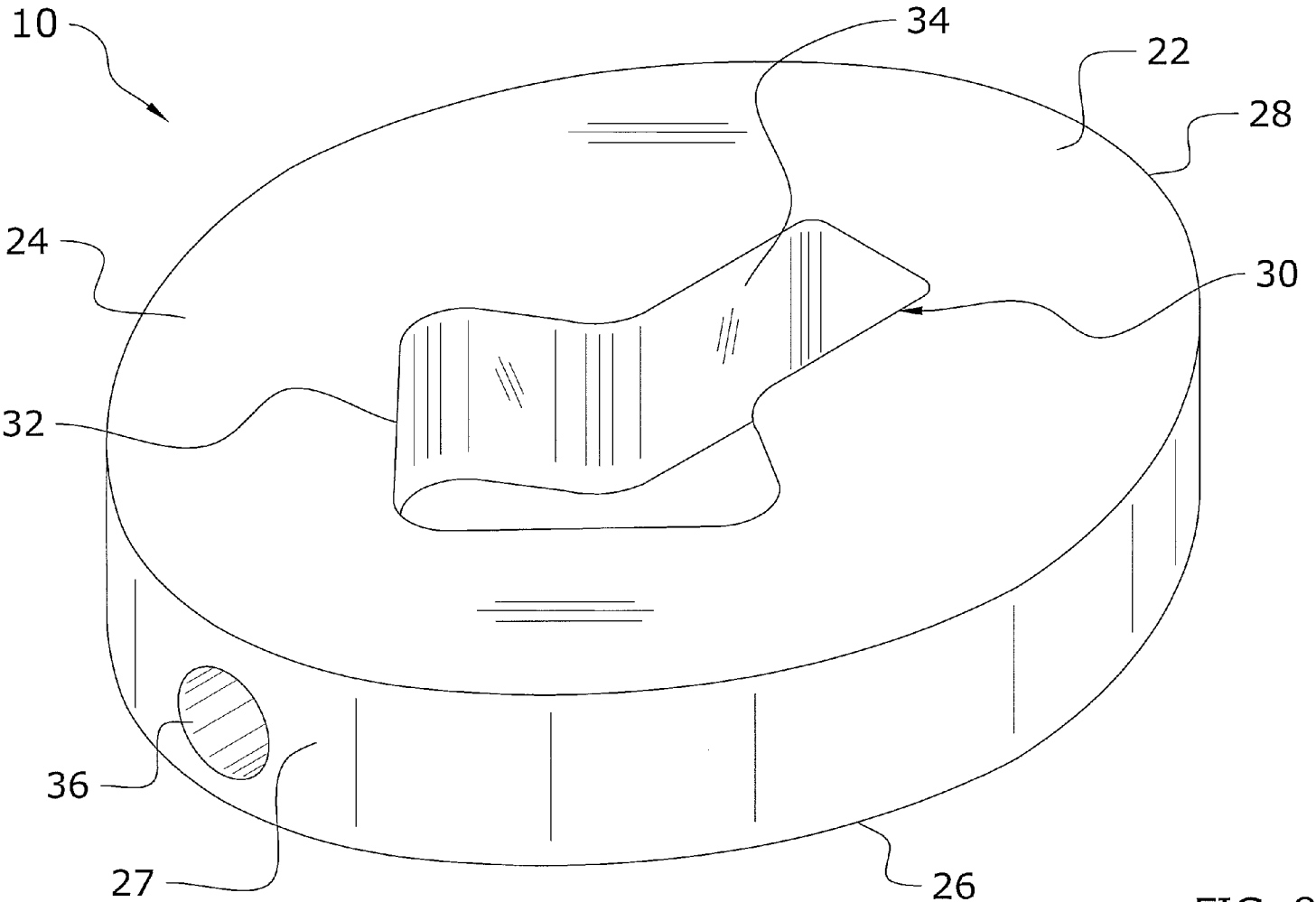
FIG. 8 is an upper perspective view of the present invention including a breathing passageway.

The first portion 32 of the receiver opening 30 is preferably substantially comprised of a triangular configuration as shown in FIGS. 1 through 7. The first portion 32 also preferably includes a plurality of corners. The latitudinal outer corners of the first portion 32 are preferably of a width great enough to receive the user's eyes so the user may see through the receiver opening 30 while the face cradle insert device 10 is in use as illustrated in FIG. 7. The corners of the first portion 32 are also preferably rounded so as to better conform to the contours of the user's face. It is appreciated that the first portion 32 may be comprised of other configurations, such as but not limited to a square, a rectangle or a circle.

The second portion 34 of the receiver opening 30 is preferably substantially comprised of a rectangular configuration as shown in FIGS. 1 through 7. The second portion 34 preferably extends substantially away from the first portion 32 to receive the user's chin as illustrated in FIG. 7. It is appreciated that the second portion 34 may be comprised of other configurations, such as but not limited to a square, a triangle or a circle.

D. Passageway

The passageway 36 is comprised of a configuration to promote easy breathing by the user while the user's face is against the upper side 24 or lower side 26 of the pad 20. The passageway 36 may be fully appreciated by the user when the pad 20 is positioned upon a planar surface and the lower end of the receiver opening 30 is covered. The passageway 36 extends horizontally through the pad 20 as illustrated in FIGS. 12 and 15. The passageway 36 also preferably fluidly interconnects with the first portion 32 of the receiver opening 30.

A concentric axis of the passageway 36 preferably aligns with the longitudinal center axis of the pad 20 and the receiver opening 30. The passageway 36 also preferably extends through the first end 27 of the pad 20 and within the first portion 32 of the receiver opening 30 as illustrated in FIGS. 8 through 15, wherein the passageway 36 interconnects the receiver opening 30 with an outside air source (i.e. air around the outer sides of the pad 20).

In the preferred embodiment the passageway 36 is comprised of a cylindrical configuration; however it is appreciated that the passageway 36 may be comprised of various other shaped configurations. It is also appreciated that the present invention may include a plurality of passageways 36 extending through the pad 20 and interconnecting with the receiver opening 30, wherein the passageways 36 may radiate from the receiver opening 30 to allow an increased airflow through the receiver opening 30 as illustrated in FIG. 16.

E. Operation of the Preferred Embodiment

In use, the face cradle insert device 10 is attached to cradle support 16 via the attachment members 18, 19. The user then lies face down on the massage table 12 while placing their face over the receiver opening 30 of the pad 20. The user aligns with the receiver opening 30 so that the user's eyes are within the outer edges of the first portion 32 of the receiver opening 30 and the user's chin is positioned near a lower end of the second portion 34 of the receiver opening 30.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

We claim:

1. A face cradle insert device, comprising:

a pad including a first end and a second end, wherein said first end is opposite said second end, a substantially horizontal planar top surface and a substantially horizontal planar bottom surface;

wherein said pad includes a receiver opening vertically extending through said pad between said first end and said second end;

wherein said pad includes at least one passageway horizontally extending through said pad and wherein said at least one passageway fluidly connects with said receiver opening;

wherein said pad is vertically tapered in a manner that a perimeter of said top surface is greater than a perimeter of said bottom surface to permit said pad to be positioned within a face cradle of a massage table.

2. The face cradle insert device of claim 1, wherein said at least one passageway includes a plurality of passageways extending through said pad.

3. The face cradle insert device of claim 1, wherein said receiver opening includes a first portion adjacent said first end of said pad and a second portion adjacent said second end of said pad, wherein said second portion extends from said first portion.

4. The face cradle insert device of claim 3, wherein said first portion is comprised of a substantially triangular configuration.

5. The face cradle insert device of claim 3, wherein said second portion is comprised of a substantially rectangular configuration.

6. The face cradle insert device of claim 3, wherein said at least one passageway extends through said first end of said pad.

7. The face cradle insert device of claim 6, wherein said at least one passageway interconnects with said first portion.

8. The face cradle insert device of claim 3, wherein a first centroid of said first portion and a second centroid of said second portion align on a longitudinal center axis of said pad.

9. The face cradle insert device of claim 8, wherein said at least one passageway is concentric with said longitudinal center axis.

10. The face cradle insert device of claim 1, wherein said pad is comprised of a foam material.

11. The face cradle insert device of claim 1, wherein said pad is comprised of an inflatable structure.

12. The face cradle insert device of claim 11, including a valve extending from said pad.

13. The face cradle insert device of claim 1, including a plurality of attachment members extending from a lower side of said pad.

14. The face cradle insert device of claim 1, including a massage table, wherein said massage table includes a cradle support extending outwardly from said massage table and wherein said pad attaches to said cradle support.

15. The face cradle insert device of claim 14, wherein said pad includes a plurality of first attachment members and said cradle support includes a plurality of second attachment members, wherein said plurality of first attachment members removably attach to said plurality of second attachment members.

16. The face cradle insert device of claim 15, wherein said plurality of first attachment members and said plurality of second attachment members are comprised of a hook and loop attachment configuration.

17. A face cradle insert device, comprising:

a pad including a first end and a second end, wherein said first end is opposite said second end, a substantially horizontal planar top surface and a substantially horizontal planar bottom surface;

wherein said pad includes a receiver opening vertically extending through said pad between said first end and said second end;

wherein said receiver opening includes a first portion adjacent said first end of said pad and a second portion adjacent said second end of said pad, wherein said second portion extends from said first portion;

wherein said pad includes at least one passageway horizontally extending through said pad;

wherein said at least one passageway extends through said first end of said pad and wherein said at least one passageway interconnects with said first portion;

wherein said at least one passageway fluidly connects with said receiver opening;

wherein said pad is vertically tapered in a manner that a perimeter of said top surface is greater than a perimeter of said bottom surface to permit said pad to be positioned within a face cradle of a massage table.

18. The face cradle insert device of claim 17, wherein said pad is comprised of an inflatable structure.

19. A face cradle insert device, comprising:

a pad including a first end and a second end, wherein said first end is opposite said second end, a substantially horizontal planar top surface and a substantially horizontal planar bottom surface;

wherein said pad includes a receiver opening vertically extending through said pad between said first end and said second end;

wherein said receiver opening includes a first portion adjacent said first end of said pad and a second portion adjacent said second end of said pad, wherein said second portion extends from said first portion;

wherein said pad includes at least one passageway horizontally extending through said pad;

wherein said at least one passageway extends through said first end of said pad and wherein said at least one passageway interconnects with said first portion;

wherein said at least one passageway fluidly connects with said receiver opening;

wherein said first portion is comprised of a substantially triangular configuration and wherein said second portion is comprised of a substantially rectangular configuration;

wherein a first centroid of said first portion and a second centroid of said second portion align on a longitudinal center axis of said pad;

wherein said at least one passageway is concentric with said longitudinal center axis;

wherein said pad is vertically tapered in a manner that a perimeter of said top surface is greater than a perimeter of said bottom surface to permit said pad to be positioned within a face cradle of a massage table.

20. The face cradle insert device of claim 19, wherein said pad is comprised of an inflatable structure.

* * * * *